US012402650B2

(12) United States Patent
Offenhartz

(10) Patent No.: US 12,402,650 B2
(45) Date of Patent: Sep. 2, 2025

(54) FATTY CADDY BOWL IN ONE

(71) Applicant: David Offenhartz, Canton, CT (US)

(72) Inventor: David Offenhartz, Canton, CT (US)

( * ) Notice: Subject to any disclaimer, the term of this patent is extended or adjusted under 35 U.S.C. 154(b) by 183 days.

(21) Appl. No.: 17/993,658

(22) Filed: Nov. 23, 2022

(65) Prior Publication Data

US 2024/0164441 A1 May 23, 2024

(51) Int. Cl.
*A24F 15/10* (2006.01)

(52) U.S. Cl.
CPC ..... *A24F 15/10* (2013.01)

(58) Field of Classification Search
CPC ..... A24F 15/10; B65D 85/109
USPC ..... 131/185–186; 206/85–89, 242–268, 457
See application file for complete search history.

(56) References Cited

U.S. PATENT DOCUMENTS 1,072,914 A * 9/1913 Comings ..... A24D 1/14 131/348
1,231,915 A * 7/1917 Lamb ..... A24F 9/16 206/244
2,112,801 A * 3/1938 Zint ..... A24F 15/20 206/253
3,915,295 A * 10/1975 Morrison ..... B65D 85/109 206/86
4,989,728 A * 2/1991 Neyret ..... B65D 85/109 206/273
D363,568 S * 10/1995 Ghrawi ..... D9/414
D419,259 S * 1/2000 Johnson ..... D9/414
6,446,793 B1 * 9/2002 Layshock ..... A24F 15/18 206/86
D554,287 S * 10/2007 Sugiharto ..... D27/189
8,113,343 B2 * 2/2012 Åkerlind ..... A24F 19/0085 206/86
8,584,842 B2 * 11/2013 Fakhouri ..... A24F 15/18 206/256
11,445,751 B2 * 9/2022 Wu ..... A24F 15/10
11,713,184 B2 * 8/2023 Goradesky ..... B65D 85/1056 206/268
2016/0198763 A1 * 7/2016 Adkins ..... A24F 15/01 206/268

* cited by examiner

*Primary Examiner* — Bryon P Gehman

(57) ABSTRACT

A brand ambassador providing end-users with a stealth device incorporating silicone chamber technology facilitating the storage of pre-rolled cigarettes, a one-hit pipe, an area for securely stashing cannabis flower, and a built-in chamber for a disposable lighter.

1 Claim, 1 Drawing Sheet

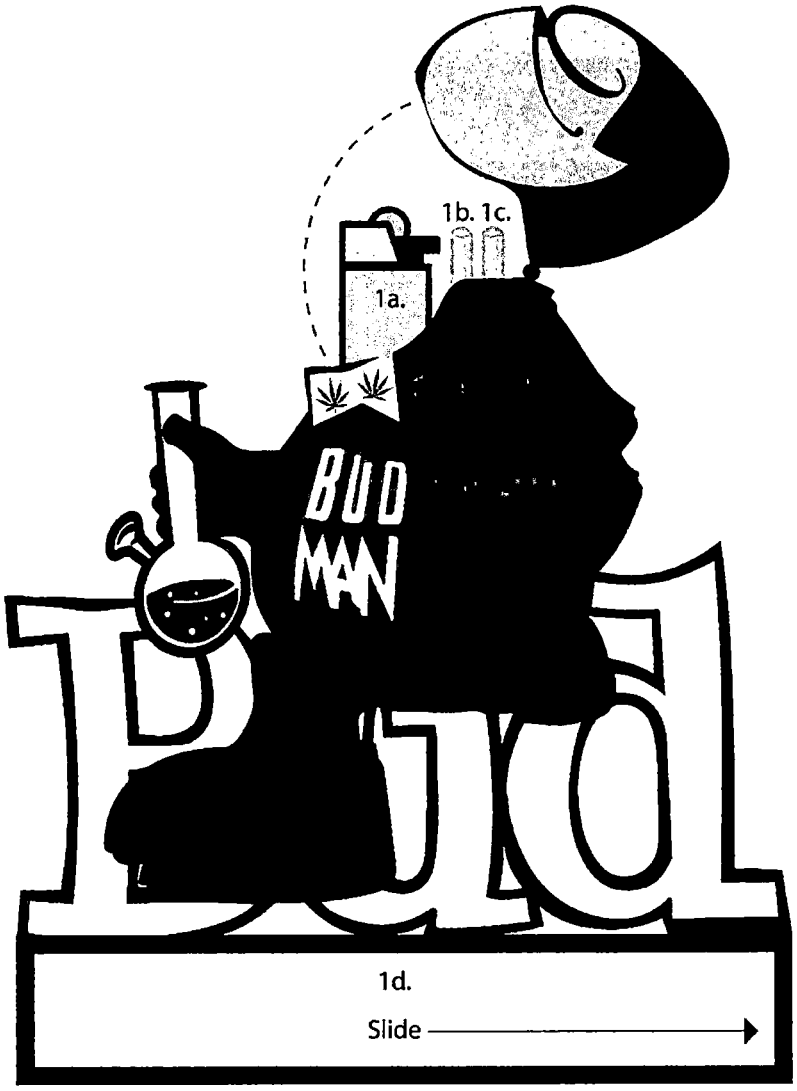
1b. 1c.
1a.
BUD
MAN
Bud
1d.
Slide

FATTY CADDY BOWL IN ONE

BACKGROUND OF THE INVENTION

The present invention relates to smoking accessories providing an end-user with a turnkey solution; specifically, one designed with silicone chambers suitable for pre-rolled cigarettes and a one-hit pipe, an area for ground cannabis or flower, and a built-in area suitable for storage of a disposable lighter, encapsulated in a brand ambassador with a closeable head.

SUMMARY OF THE INVENTION

Cannabis end-users need a few things; a lighter, a cannabis cigarette, maybe a one-hit bat, a place to secure medicine. The majority of cannabis dispensaries world-wide sell each of these products individually, and often in pairs. It's not uncommon for an individual to exit a dispensary with a bag containing every item listed above. The Fatty Caddy Bowl in One is the first device of its kind; in that it accommodates each of the above elements—in a self-contained stealth device.

BRIEF SUMMARY OF FIG. 1

FIG. 1 is a frontal view of The Fatty Caddy Bowl in One. The elements of the invention are clearly labeled 1*a*. 1*b*. 1*c*. 1.*d*.

DETAILED SUMMARY OF FIG. 1

FIG. 1 illustrates The Fatty Caddy Bowl in One, a brand ambassador supporting the normalization of medical and recreational cannabis.

The plastic device is a smoking accessory, offering end-user cannabis enthusiasts with a turnkey and stealth solution.

The components of Diagram 1:

A plastic brand ambassador with a hinged head that opens to reveal the following elements:

1*a*. an insert suitable for storage of disposable lighter.

1*b*. silicone tube for storage of pre-rolled cigarette.

1*c*. silicone tube for storage of one-hit pipe.

1*d*. silicone chamber with slide for storage of cannabis.

What is claimed:

1. A smoking accessory with a hinged lid, comprising of three vertically oriented storage areas, wherein in one storage area is for holding a lighter, another storage area for holding a pre-rolled cigarette, the third storage area for holding a one-hit pipe, and a horizontally sliding silicone chamber which can slide open and accommodate an area for dried plant matter.

* * * * *